US011358267B2

(12) United States Patent
Benge et al.

(10) Patent No.: US 11,358,267 B2
(45) Date of Patent: Jun. 14, 2022

(54) TOOL GUARD

(71) Applicant: Bell Textron Inc., Fort Worth, TX (US)

(72) Inventors: Chester Daniel Benge, Amarillo, TX (US); Lloyd Patrick Drake, Amarillo, TX (US); Kevin Scott Jones, Amarillo, TX (US); Mike Melvin Whealy, Amarillo, TX (US)

(73) Assignee: Textron Innovations Inc., Providence, RI (US)

( * ) Notice: Subject to any disclaimer, the term of this patent is extended or adjusted under 35 U.S.C. 154(b) by 187 days.

(21) Appl. No.: 16/567,546

(22) Filed: Sep. 11, 2019

(65) Prior Publication Data

US 2021/0069887 A1 Mar. 11, 2021

(51) Int. Cl.
*B25F 5/02* (2006.01)

(52) U.S. Cl.
CPC ..... *B25F 5/02* (2013.01)

(58) Field of Classification Search
CPC ..... B25F 5/02; B23Q 11/08
USPC ..... 173/171
See application file for complete search history.

(56) References Cited

U.S. PATENT DOCUMENTS 4,955,984 A * 9/1990 Cuevas ..... B23Q 11/0053 408/67
5,083,621 A * 1/1992 Sheridan ..... A61B 17/7001 173/164
5,160,230 A * 11/1992 Cuevas ..... B23Q 11/0053 408/67
5,440,809 A * 8/1995 Padilla ..... B23Q 11/0046 30/124
5,653,561 A * 8/1997 May ..... B23Q 11/0046 408/67
5,688,082 A * 11/1997 Richardson ..... B23Q 11/0046 408/113
8,978,781 B2 * 3/2015 Burdick ..... B25D 17/20 173/198
2009/0197515 A1 * 8/2009 Wang ..... B24B 55/052 451/451
2010/0105300 A1 * 4/2010 Esenwein ..... B24B 55/052 451/359
2010/0248599 A1 * 9/2010 Voigt ..... B24B 55/052 451/359
2011/0008117 A1 * 1/2011 Kasuya ..... B25D 16/00 408/67
2012/0210535 A1 * 8/2012 Miwa ..... B23Q 11/0046 15/246
2013/0152354 A1 * 6/2013 Cobzaru ..... B21J 15/105 29/401.1
2013/0220657 A1 * 8/2013 Esenwein ..... B25F 5/02 173/170
2013/0239940 A1 * 9/2013 Petersson ..... F01N 1/00 125/13.01

(Continued)

*Primary Examiner* — Eyamindae C Jallow
(74) *Attorney, Agent, or Firm* — Shackelford, Bowen, McKinley & Norton, LLP

(57) ABSTRACT

An example of a guard for a power tool includes a body that defines an interior space configured to receive the power tool. The body is configured to cover at least a moving portion of the power tool. The body includes an aperture formed through a bottom face of the body and a fastener configured to pass through the aperture and secure the guard to the power tool.

19 Claims, 4 Drawing Sheets

(56) References Cited

U.S. PATENT DOCUMENTS

| | | | | |
|---|---|---|---|---|
| 2013/0344780 | A1* | 12/2013 | Boeck | B24B 55/052 451/451 |
| 2013/0344781 | A1* | 12/2013 | Boeck | B24B 55/052 451/451 |
| 2014/0102742 | A1* | 4/2014 | Eshleman | B25B 23/147 173/183 |
| 2015/0135889 | A1* | 5/2015 | Boeck | B24B 23/005 74/531 |
| 2015/0202738 | A1* | 7/2015 | Boeck | B24B 55/052 451/359 |
| 2018/0236621 | A1* | 8/2018 | Arthur | B23Q 11/005 |
| 2019/0291241 | A1* | 9/2019 | Brown | B24B 55/052 |
| 2020/0223024 | A1* | 7/2020 | Peterson | B23Q 11/0071 |

* cited by examiner

TOOL GUARD

TECHNICAL FIELD

The present disclosure relates generally to safety equipment and more particularly, but not by way of limitation, to preventing pinching injuries caused by hand tools.

BACKGROUND

This section provides background information to facilitate a better understanding of the various aspects of the disclosure. It should be understood that the statements in this section of this document are to be read in this light, and not as admissions of prior art.

A pulling head is a conventional tool that is used to set a fastener, such as rivet, to join together two or more components. Pulling heads are often used in manufacturing processes in, for example, the aerospace and automotive industries. Typically, the pulling head is coupled to a hydraulic or pneumatic power tool that is configured to actuate the pulling head. By way of example, a pulling head may include a frame in which a carrier sits. The carrier is movably secured to the frame so that the carrier may translate between two positions (i.e., an extended position and a retracted position). The carrier includes jaws designed to engage a stem of a fastener, such as a rivet, that is positioned within an aperture of one or more workpieces. When the power tool is actuated, the carrier is retracted. As the carrier is retracted, the jaws of the pulling head grip the stem of the fastener to apply a tensile force to the fastener. The tensile force exerted upon the stem causes a head of the stem to expand a shank of the fastener, which causes the fastener to set within the two or more components and the stem to break away.

Pneumatically or hydraulically actuated pulling heads are often used in hand-held form by workers as a part of the manufacturing process. Handling a pulling head by hand can be dangerous as it is possible for a hand of the worker to be pinched by the action of the carrier as it translates between its first and second positions.

SUMMARY

This summary is provided to introduce a selection of concepts that are further described below in the detailed description. This summary is not intended to identify key or essential features of the claimed subject matter, nor is it to be used as an aid in limiting the scope of the claimed subject matter.

An example of a guard for a power tool includes a body that defines an interior space configured to receive the power tool. The body is configured to cover at least a moving portion of the power tool. The body includes an aperture formed through a bottom face of the body and a fastener configured to pass through the aperture and secure the guard to the power tool.

An example of a guard system for a tool includes a pulling head comprising a frame and a carrier movably disposed within the frame. The guard system includes a guard comprising a body that defines an interior space configured to receive the pulling head. The body is configured to cover at least a moving portion of the pulling head. The body includes an aperture formed through a bottom face of the body and a fastener configured to pass through the aperture and secure the guard to the pulling head.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
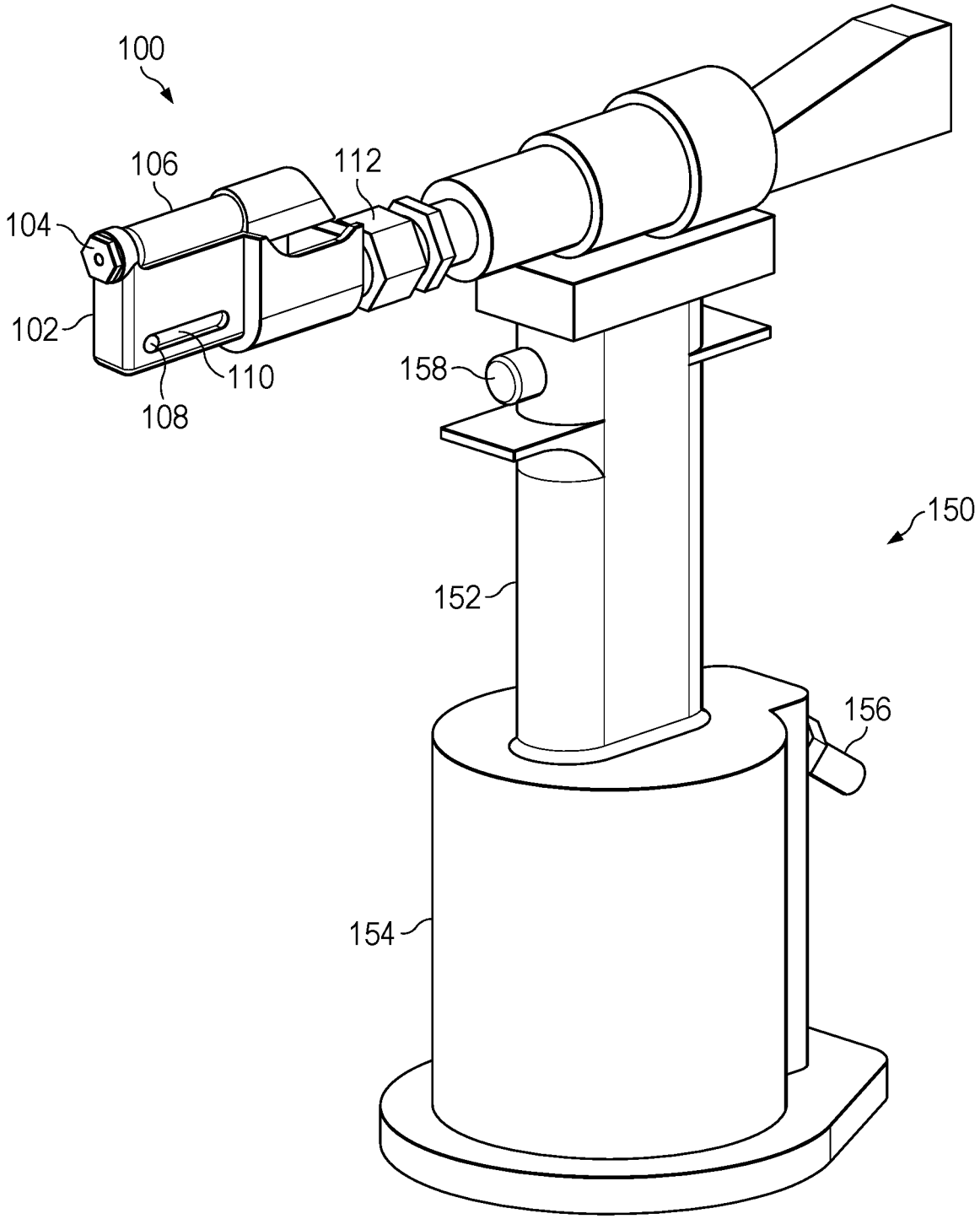
FIG. 1 illustrates a pulling head secured to a power tool according to aspects of the disclosure.

It is to be understood that the following disclosure provides many different aspects, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

In the specification, reference may be made to the spatial relationships between various components and to the spatial orientation of various aspects of components as the devices are depicted in the attached drawings. However, as will be recognized by those skilled in the art after a complete reading of the present disclosure, the devices, members, apparatuses, etc. described herein may be positioned in any desired orientation. Thus, the use of terms such as "above," "below," "upper," "lower," or other like terms to describe a spatial relationship between various components or to describe the spatial orientation of aspects of such components should be understood to describe a relative relationship between the components or a spatial orientation of aspects of such components, respectively, as the device described herein may be oriented in any desired direction.

Figure 2A:
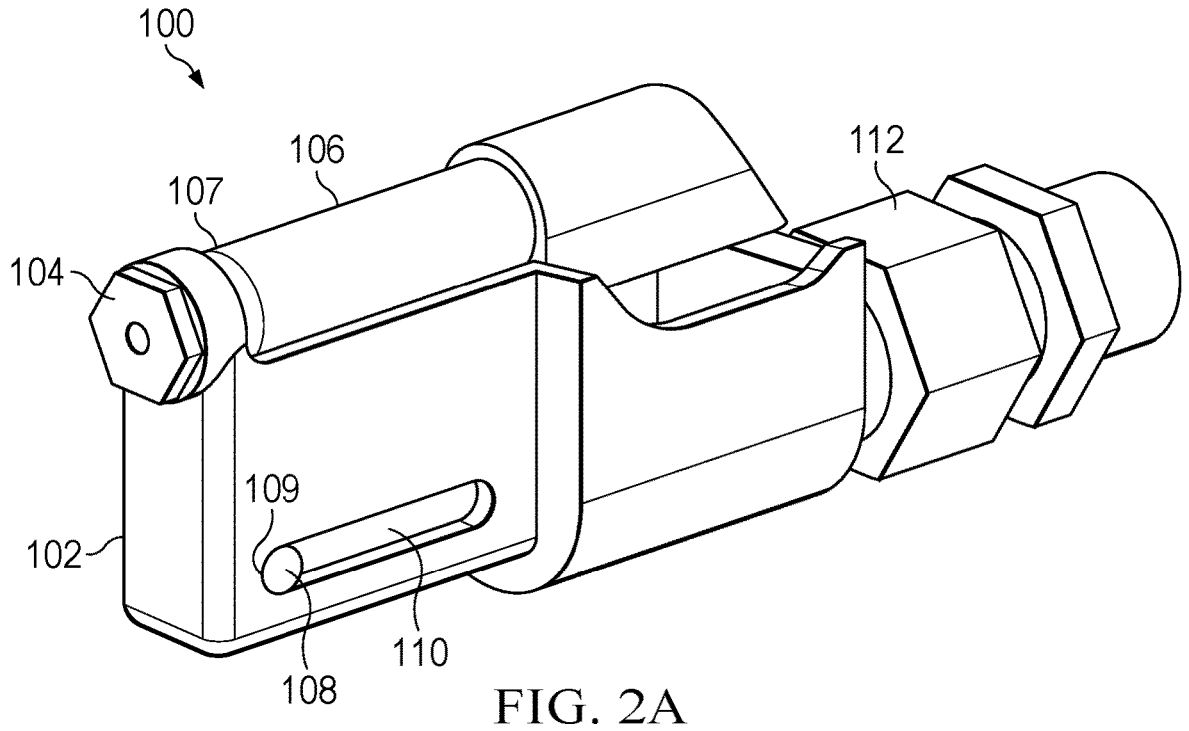
FIGS. 2A and 2B illustrate a pulling head in extended and retracted positions, respectively, according to aspects of the disclosure.
Figure 2B:
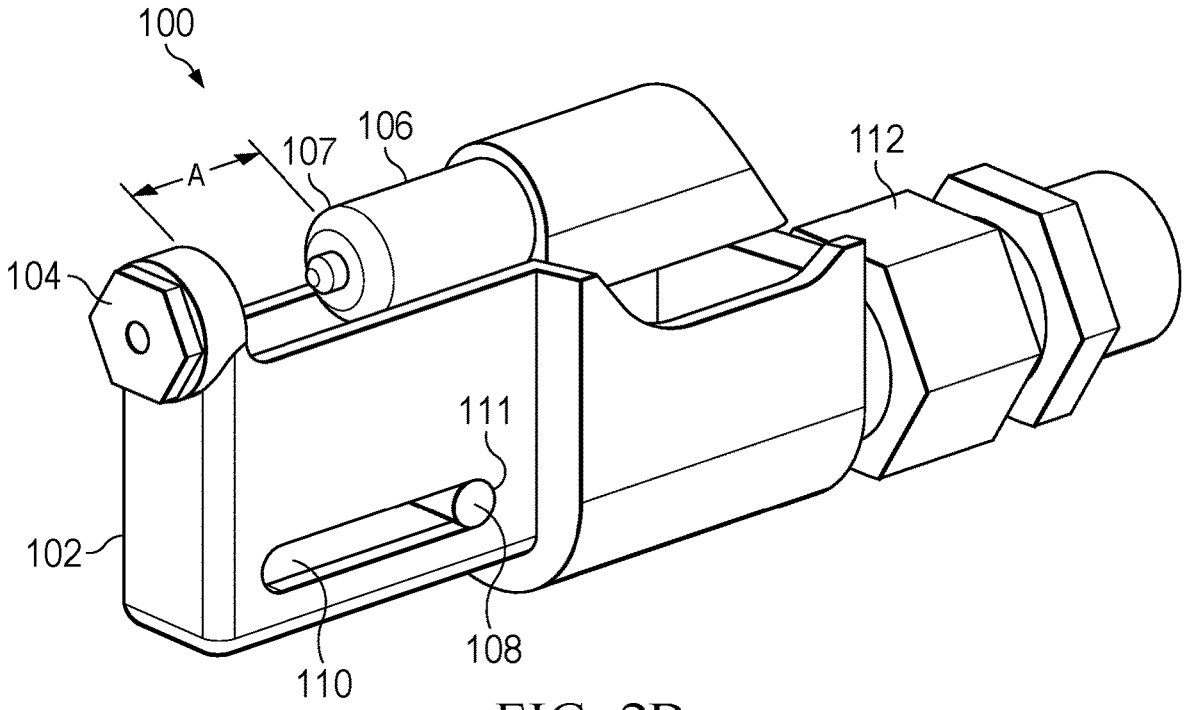
Figure 3:
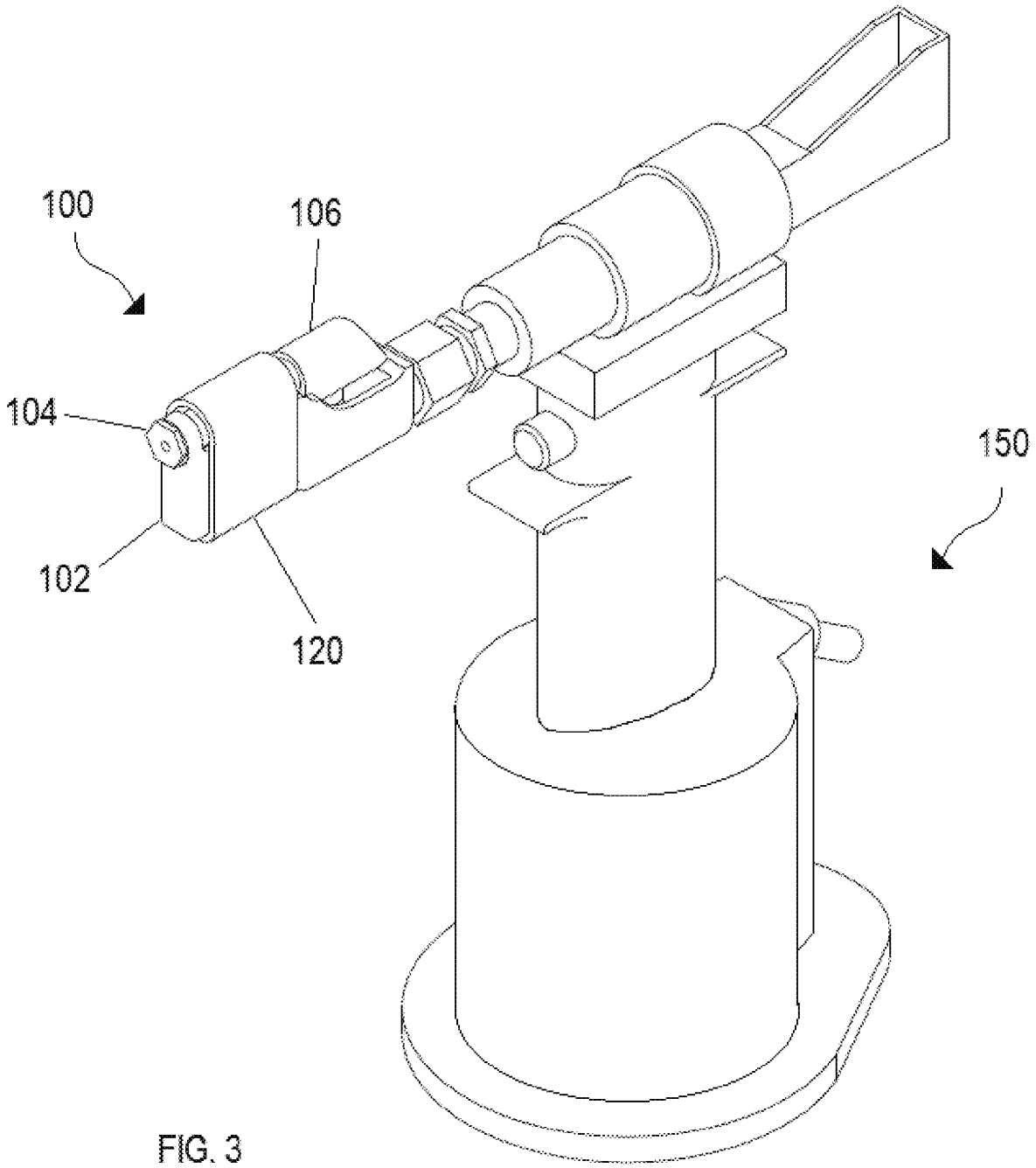
FIG. 3 illustrates a pulling head with a guard installed according to aspects of the disclosure.

FIG. 1 illustrates a pulling head 100 secured to a power tool 150 according to aspects of the disclosure. Pulling head 100 includes a frame 102 that includes a nosepiece 104. Nosepiece 104 is a guide that receives a stem of a fastener and guides the stem into a carrier 106. Carrier 106 is movably secured to frame 102 by a pin 108. Pin 108 passes through an aperture within carrier 106 and extends into a slot 110 of frame 102. The pinned connection of carrier 106 allows carrier 106 to move between an extended position (as illustrated in FIGS. 1 and 2A) and a retracted position (as illustrated in FIG. 2B). Carrier 106 includes jaws positioned within carrier 106 that are aligned with nosepiece 104 to receive and engage a stem of a fastener, such as a rivet. Pulling head 100 includes a connector 112 that secures pulling head 100 to power tool 150. Power tool 150 may be a pneumatic, hydraulic, or electric power tool. As illustrated in FIGS. 1 and 3, power tool 150 is a pneumatic power tool. Those having skill in the art will appreciate that aspects of the disclosure apply to other power tool types and are not limited to pneumatic power tools. Connector 112 is a pressurized connection that allows power tool 150 to apply a pneumatic force to carrier 106 to move carrier 106 between the extended and retracted positions.

Power tool 150 includes a handle portion 152, a reservoir 154, an air inlet 156, and an actuator 158. Handle portion 152 provides a hand-hold for a user of power tool 150. Reservoir 154 stores pressurized air that is supplied to power tool 150 by an air compressor or compressed air tank via air inlet 156. The user actuates pulling head 100 via actuator 158, which may be a button or trigger. Pressing actuator 158 supplies pneumatic force to carrier 106 to retract carrier 106 into the retracted position (e.g., see FIG. 2B). After application of the pneumatic force to carrier 106 stops, carrier 106 extends back into the extended position (e.g., see FIGS. 1 and 2A).

FIGS. 2A and 2B illustrate pulling head 100 in extended and retracted positions, respectively, according to aspects of the disclosure. Power tool 150 is hidden from view in FIGS. 2A and 2B. In the extended position shown in FIG. 2A, a distal end 107 of carrier 106 is positioned proximal to nosepiece 104 of frame 102 and pin 108 is positioned in a distal end 109 of slot 110. In the retracted position shown in FIG. 2B, distal end 107 of carrier 106 has moved away from nosepiece 104 and pin 108 is positioned in a proximal end 111 of slot 110. In the retracted position, a gap A is formed between nosepiece 104 and distal end 107. During operation of pulling head 100, a user sometimes operates power tool 150 with one hand and places the opposite hand upon pulling head 100 for additional support and/or control of the tool. Placing a hand on pulling head 100 can be helpful to more precisely guide the tool onto a stem of a fastener. While gripping pulling head 100 may help position the tool, it can lead to injury due to the movement of pin 108 and/or carrier 106. For example, the hand of the user may become pinched between pin 108 and distal end 109/proximal end 111 or between distal end 107 of carrier 106 and nosepiece 104. To eliminate the possibility of a foreign object, such as a user's hand, from becoming pinched by pulling head 100, a guard may be secured to pulling head 100.

FIG. 3 illustrates a guard 120 secured to pulling head 100 according to aspects of the disclosure. Guard 120 covers the movable portion of pulling head 100 (e.g., carrier 106 and pin 108) to remove pinch points from pulling head 100. For example, guard 120 covers carrier 106 such that gap A and slot 110 are not exposed. Covering gap A and slot 110 eliminates the risk of objects, such as a user's hand, glove, hair, article of clothing, and the like, becoming pinched between distal end 107 and nosepiece 104 and/or pin 108 and distal end 109/proximal end 111 of slot 110.

Figure 4:
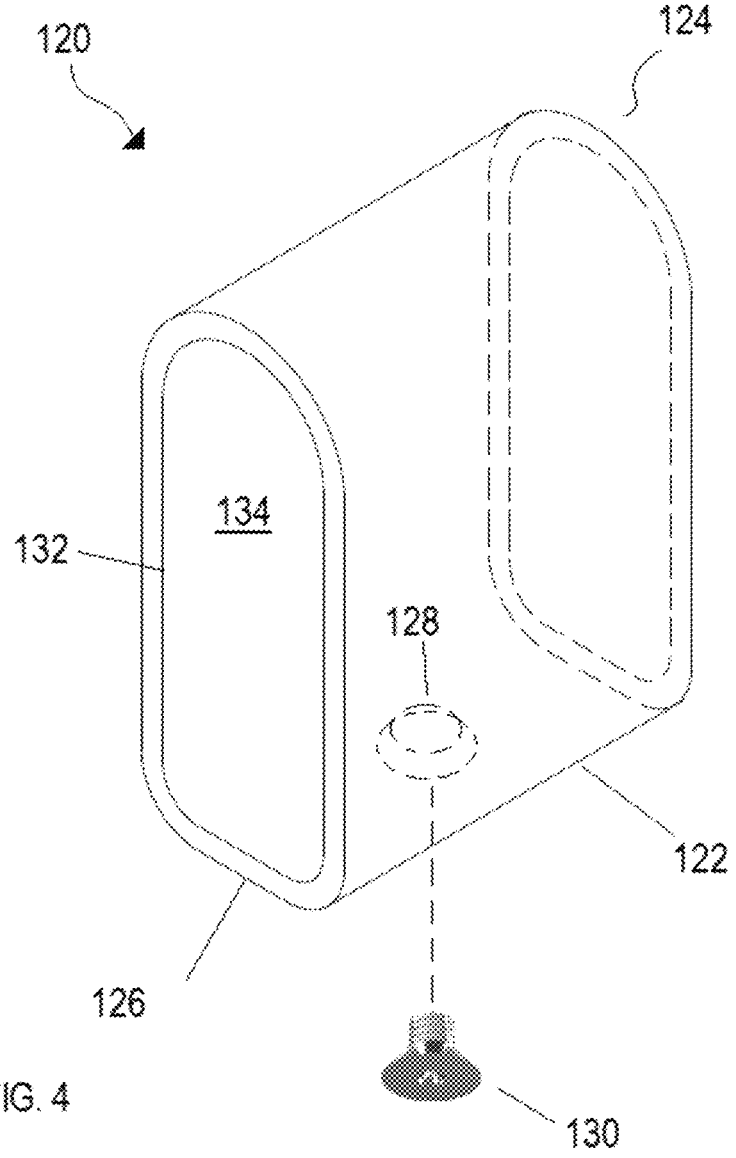
FIG. 4 illustrates a tool guard according to aspects of the disclosure.

FIG. 4 illustrates a perspective view of guard 120 according to aspects of the disclosure. Guard 120 comprises a body 122 that forms a sleeve that closely fits around frame 102 and carrier 106 of pulling head 100. Body 122 is formed by a wall 132. Wall 132 forms an interior space 134 that accommodates frame 102 and carrier 106 of pulling head 100. Guard 120 includes a face 126 on a bottom side of body 122 that includes an aperture 128. Aperture 128 may be, for example, a countersunk hole configured to receive a fastener 130 therethrough. Fastener 130 may be, for example, a screw with a countersunk head that threads into a bore formed into an underside of frame 102 to secure guard 120 to pulling head 100. Countersinking aperture 128 allows fastener 130 to mount flush with body 122 so as not to protrude from body 122. In other aspects, body 122 may be sized to fit onto pulling head 100 via force fit. In such aspects, body 122 is dimensioned so that the force fit is formed between body 122 and frame 102 such that movement of carrier 106 and pin 108 are not obstructed. For example, sides of body 122 grip frame 102 while an upper portion 124 of body 122 is spaced apart from and does not contact carrier 106.

In some aspects, body 122 is sized to closely fit pulling head 100 so as to not add additional bulk or size to pulling head 100. Minimizing the size of body 122 helps ensure that pulling head 100 can fit into tighter spaces. For example, an upper portion 124 of body 122 is curved to complement the contour of carrier 106. As used herein, "complement the contour of the carrier 106" is used to mean that upper portion 124 closely follows the rounded shape of carrier 106 while at the same time limiting or prevent contact between body 122 and carrier 106 so as to not obstruct the movement of carrier 106. Body 122 also closely fits frame 102, but maintains clearance between pin 108 so as not to obstruct the movement of pin 108. In other aspects, upper portion 124 may have a different shape as long as the movement of carrier 106 is not obstructed. For example, upper portion 124 may have a box-like profile with squared off edged instead of the rounded profile illustrated in FIG. 4.

In some aspects, body 122 may include a surface treatment to improve the gripability of guard 120. For example, some or all of an external surface of body 122 may be knurling treatment or may include one or more grooves that complement the fingers of a user to improve a user's grip of pulling head 100. In some aspects, guard 120 may include a handle that extends from guard 120 for a user to hold onto while using pulling head 100. For example, the handle may extend down from guard 120 or to the side of guard 120. The handle may comprise a pistol grip handle or the like.

As will be appreciated by those having skill in the art, the above disclosure is relevant to a variety of different tools and is not limited to pneumatic tools. The guards disclosed above could be used in connection with pneumatic tools, hydraulic tools, electrical tools, mechanically actuated tools, and the like.

The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," "generally," and "about" may be substituted with "within [a percentage] of" what is specified, where the percentage includes 0.1, 1, 5, and 10 percent.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A guard for a power tool, the guard comprising:

an annular body defining an interior space for receiving the power tool and configured to cover at least a linearly reciprocating portion of the power tool;

wherein the annular body has an aperture formed through a face of the annular body;

a fastener configured to pass through the aperture and secure the guard to the power tool; and wherein the at least the linearly reciprocating portion of the power tool comprises a portion of the power tool at which a gap forms between a carrier of the power tool and a nosepiece of the power tool when the carrier is in a retracted position.

2. The guard of claim 1, wherein the body comprises an upper portion that is curved to complement a contour of the power tool.

3. The guard of claim 1, wherein the body comprises a surface treatment applied to at least a portion of an exterior surface of the body.

4. The guard of claim 3, wherein the surface treatment comprises a knurling treatment.

5. The guard of claim 3, wherein the surface treatment comprises one or more grooves that complement fingers of a user.

6. The guard of claim 1, comprising a handle secured to the body.

7. The guard of claim 1, wherein the at least the linearly reciprocating portion of the power tool comprises a slot formed into a frame of the power tool.

8. A guard system for a power tool, the guard system comprising:

a pulling head comprising a frame and a carrier movably disposed within the frame; and a guard defining an interior space configured to receive the pulling head and configured to cover at least a moving portion of the pulling head, the guard comprising:

an aperture formed through a bottom face of the guard; and a fastener configured to pass through the aperture and secure the guard to the pulling head.

9. The guard system of claim 8, wherein the guard comprises an upper portion that is curved to complement a contour of the carrier.

10. The guard system of claim 8, wherein the guard comprises a surface treatment applied to at least a portion of an exterior surface of the guard.

11. The guard system of claim 10, wherein the surface treatment comprises a knurling treatment.

12. The guard system of claim 10, wherein the surface treatment comprises one or more grooves that complement fingers of a user.

13. The guard system of claim 8, comprising a handle secured to the guard.

14. The guard system of claim 8, wherein the at least the moving portion of the pulling head comprises a portion of the pulling head at which a gap forms between the carrier and a nosepiece of the pulling head when the carrier is in a retracted position.

15. The guard system of claim 8, wherein the at least the moving portion of the pulling head comprises a slot formed into the frame of the pulling head.

16. A guard for a power tool, the guard comprising:

a body defining an interior space for receiving the power tool and configured to cover at least a moving portion of the power tool;

wherein the body has an aperture formed through a bottom face of the body;

a fastener configured to pass through the aperture and secure the guard to the power tool; and wherein the at least the moving portion of the power tool comprises a portion of the power tool at which a gap forms between a carrier of the power tool and a nosepiece of the power tool when the carrier is in a retracted position.

17. The guard of claim 16, wherein the body comprises an upper portion that is curved to complement a contour of the power tool.

18. The guard of claim 16, comprising a handle secured to the body.

19. The guard of claim 16, wherein the at least the moving portion of the power tool comprises a slot formed into a frame of the power tool.

* * * * *